US009722358B1

(12) United States Patent
Galpchian

(10) Patent No.: US 9,722,358 B1
(45) Date of Patent: Aug. 1, 2017

(54) POWER CORD RETAINER

(71) Applicant: Levon Galpchian, Cranston, RI (US)

(72) Inventor: Levon Galpchian, Cranston, RI (US)

(73) Assignee: Tower Manufacturing Corp, Providence, RI (US)

( * ) Notice: Subject to any disclaimer, the term of this patent is extended or adjusted under 35 U.S.C. 154(b) by 0 days.

(21) Appl. No.: 15/135,437

(22) Filed: Apr. 21, 2016

(51) Int. Cl.
*H01R 13/62* (2006.01)
*H01R 13/639* (2006.01)
*H01R 24/28* (2011.01)

(52) U.S. Cl.
CPC ..... *H01R 13/6395* (2013.01); *H01R 24/28* (2013.01)

(58) Field of Classification Search
CPC H01R 13/6395; H01R 24/28; H01R 13/5804; H01R 13/629; H01R 13/6392
USPC ..... 439/373
See application file for complete search history.

(56) References Cited

U.S. PATENT DOCUMENTS 7,140,903 B2 * 11/2006 Pulizzi ..... H01R 13/5804 439/371
7,264,497 B1 * 9/2007 Lewis ..... H01R 13/6392 439/371
7,559,788 B2 * 7/2009 Legg ..... H01R 13/6395 439/371
7,722,380 B1 * 5/2010 West ..... H01R 13/6395 439/373
7,850,478 B2 * 12/2010 Lin ..... H01R 13/6395 439/372
8,529,285 B1 * 9/2013 Sievers ..... H01R 13/6395 439/373
8,975,518 B1 * 3/2015 Gretz ..... H02G 3/086 174/50
9,276,357 B2 * 3/2016 Hutchison ..... H01R 13/629
2002/0068477 A1 * 6/2002 Chen-Chiang ..... H01R 13/6395 439/373
2006/0046557 A1 * 3/2006 Pulizzi ..... H01R 13/5804 439/371

* cited by examiner

*Primary Examiner* — Jean F Duverne

(57) ABSTRACT

A Power Cord Retainer is disclosed for retaining a power cord in an electrical receptacle even when the cord is subjected to an extraction force. The retainer comprises a substantially flat rear panel having a left side, right side and top side that define a u-shaped interior midsection. Opposing side panels extend forward of the rear panel and include an outwardly extending clip having a hooked end adaptable for engagement and securement of a power cord plug in a receptacle. The u-shaped interior midsection is adaptable for engagement between an electrical enclosure exterior panel and a receptacle lip extension.

9 Claims, 7 Drawing Sheets

POWER CORD RETAINER

FIELD OF THE INVENTION

The invention presented in this application pertains generally to cord retainers. More particularly, the present invention relates to retaining a detachable cord plugged into a power outlet of an electronic device.

DESCRIPTION OF PRIOR ART (BACKGROUND)

The purpose of a power cord is to make and maintain an electrical connection between a power source and a device. In doing so, power necessary to operate the device is provided. In most cases, the cord can be easily removed from the power outlet. In the case of computer equipment, the power cord is often made removable from the equipment as well. The obvious problem with the use of removable power cords is the accidental removal of the cord from either the equipment or the outlet causing the equipment to shut down. One solution to this problem is to place the cords in locations that reduce the possibility that they will be accidentally removed, such as by running the power cord under the flooring that carries pedestrian traffic.

While this is helpful, subfloor wiring is still subject to accidental forces. A similar solution involves placing a conduit on top of the floor so as to prevent someone from accidentally tripping over the cord. Unfortunately, conduits are not usually affixed to the floor and can be moved, which may cause the cord to pull out from either the equipment or the power source. When a cord cannot be buried or hidden, it is more likely that it could be accidentally disconnected. This can be disastrous when the equipment is an essential computer or networking device, because vital computer services can or will be lost when the cord is disconnected. This can also be problematic in refrigerated dispensers such as soda machines and food dispensers when service personnel may inadvertently dislodge a power cord during servicing and the unit remains shut off spoiling the contents therein.

A common solution to this problem is to secure the cord with an integrated fastener. This approach is more prevalent on data cables then on electrical supply cords. For example, the data cables between computers and peripherals often utilize screws or other attachment devices integrated into the plug. When the plug is attached to a computing device, the attachment mechanisms in the plug can be secured into mating receptacles on the device. One problem with this solution is that these cords are very specific. In other words, the device receptacle and the cable plug must be of such a design that the electrical connection and mechanical retention features line up and mate perfectly with one another.

New cords with the latest attachment mechanism may not match with older equipment, and vice versa. Accordingly, it is desirable to provide an apparatus that allows a technician to fasten and secure a power cord efficiently and effectively regardless of variations in the external size and shape of the power cord plug. In addition, it is desirable to provide an apparatus that allows the technician to connect and secure a cable without the need for any specialized tools.

SUMMARY OF INVENTION

A Power Cord Retainer is disclosed for retaining a power cord in an electrical receptacle even when the cord is subjected to an extraction force. The retainer comprises a substantially flat rear panel having a left side, right side and top side that define a u-shaped interior midsection. Opposing side panels extend forward of the rear panel and include an outwardly extending Clip having a hooked end adaptable for engagement and securement of a power cord plug in a receptacle. The u-shaped interior midsection is adaptable for engagement between an electrical enclosure exterior panel and a receptacle lip extension.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION

Figure 2:
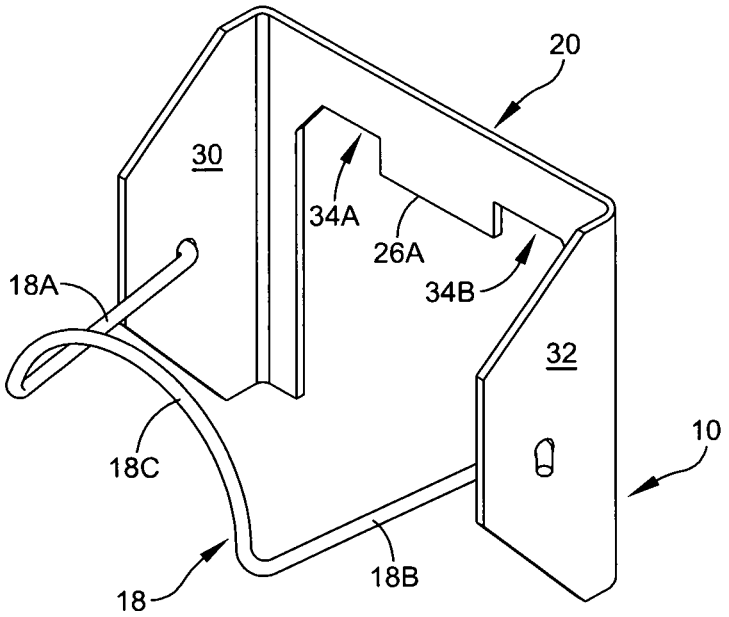
FIG. 2 is a perspective view of the power cord retainer of the present invention.
Figure 4:
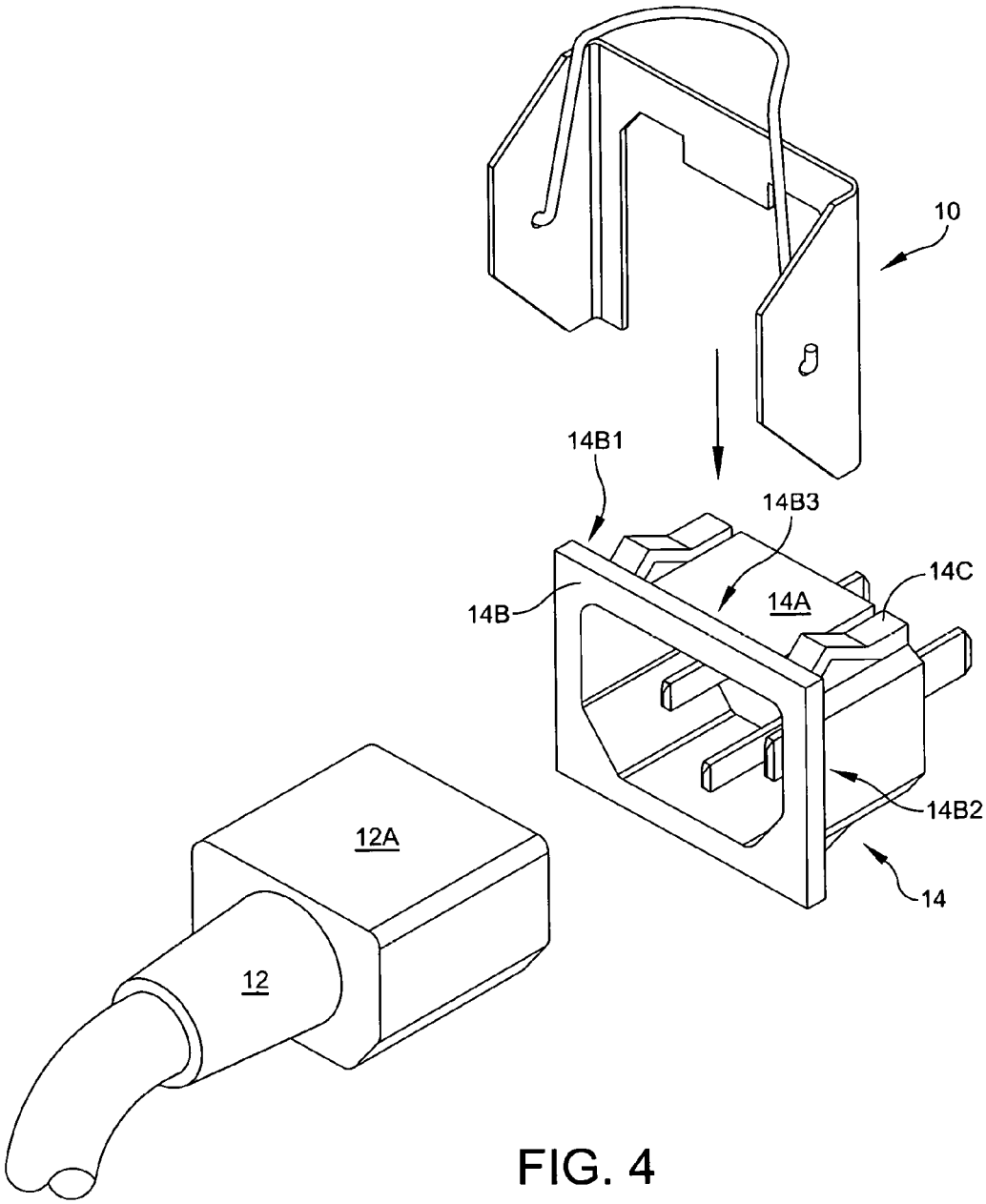
FIG. 4 is a perspective view of the power cord retainer of the present invention shown with a power cord and power receptacle.
Figure 5:
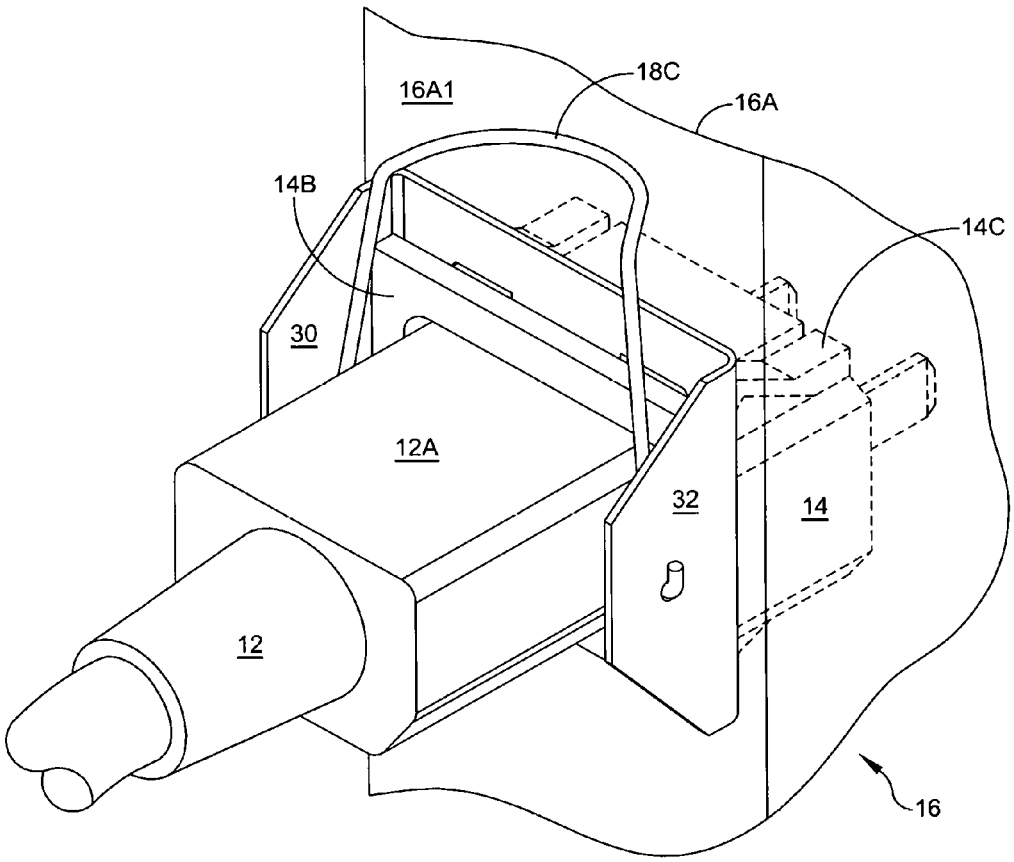
FIG. 5 illustrates the power cord retainer of the present invention installed on the face of an electrical enclosure, but disengaged.

Referring now to FIG. 2 and FIG. 5, there is shown a first embodiment of a Power Cord Retainer 10 according to the teachings of the present invention, the Power Cord Retainer 10 illustrated in FIG. 5 in combination with a power cord 12 and power input receptacle 14 as utilized with an electronic device enclosure 16 (showing only the side panel 16A1 of the device enclosure 16). As illustrated in FIG. 4, a typical IEC receptacle 14, as included as a power input to a variety of electronic apparatus, is shown. The IEC receptacle includes a body portion 14A including a front face lip extension 14B having left 14B1, right 14B2 and top 14B3 rear surfaces.

Figure 7:
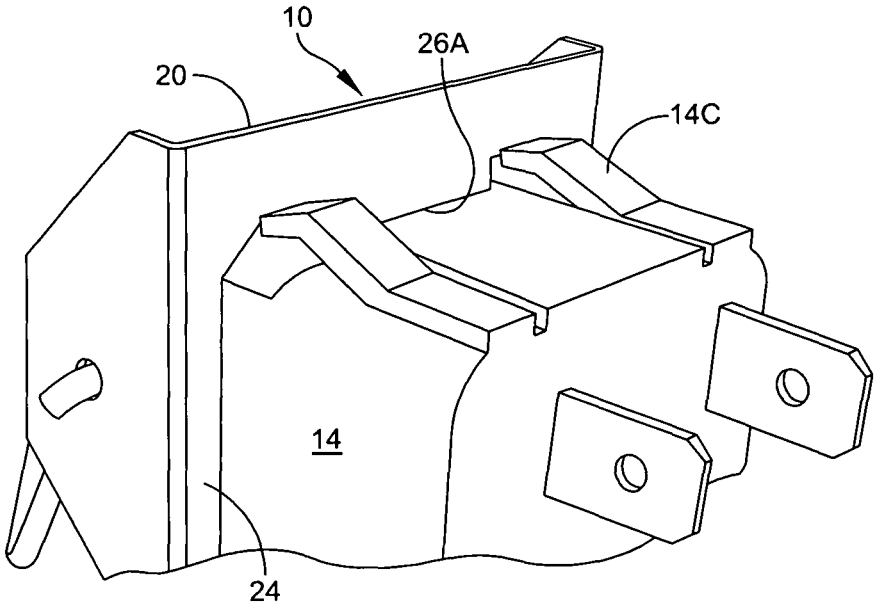
FIG. 7 illustrates the power cord retainer of the present invention in engagement with a device receptacle.
Figure 8:
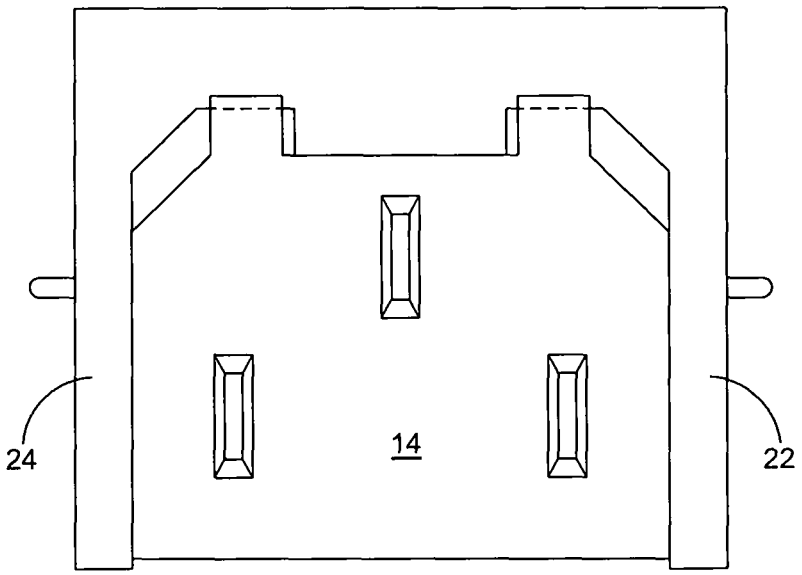
FIG. 8 is a rear view of FIG. 7.
Figure 9:
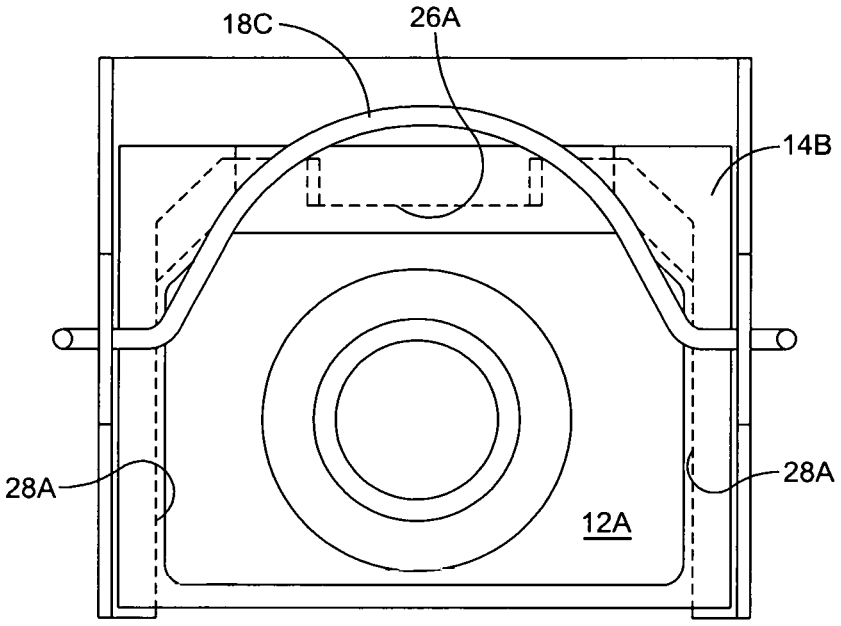
FIG. 9 is a front view of FIG. 6.
Figure 10:
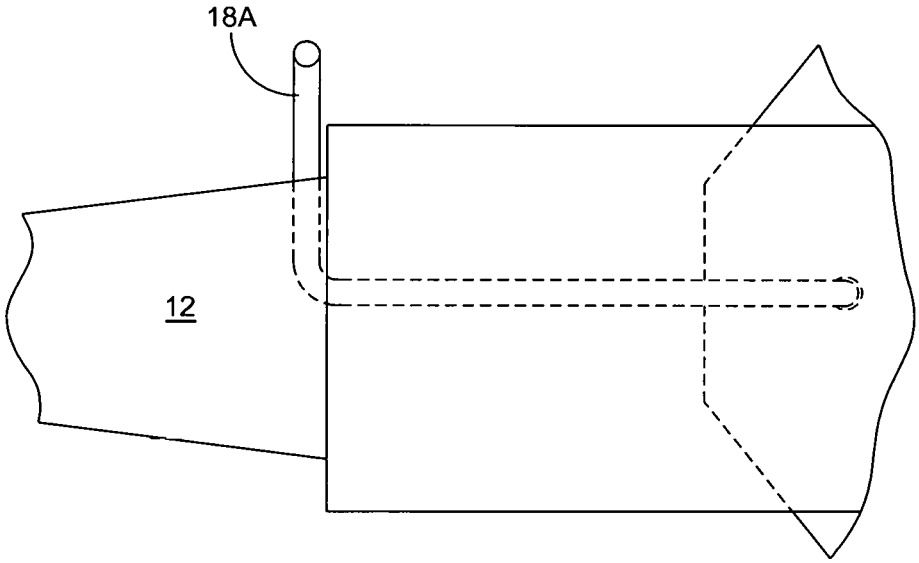
FIG. 10 is a left side view of FIG. 6.

As illustrated in FIG. 5 and FIG. 7, as typically configured, receptacle 14 includes resiliently flexible retention bars 14C for securing receptacle 14 within an electronic device enclosure 16. The opening in enclosure 16 would be dimensioned to the size of receptacle 14 body portion 14A. When the receptacle is inserted into enclosure 16, receptacle retention bars 14C flex downward as they contact the periphery of the enclosure 16 opening, then spring to their normal position against panel 16A interior side surface as the receptacle 14 is fully inserted. At that point receptacle 14 front face lip extension 14B left 14B1, right 14B2 and top 14B3 rear surfaces (FIG. 4), are forced against electronic device enclosure 16 panel 16A front surface 16A1 for securement of the receptacle 14 within device enclosure 16.

IEC receptacle 14 typically includes retention bars 14C on both the top and bottom (not shown) of receptacle 14. In some installation environments, and dependent on the enclosure material and opening in enclosure 16, retention bars 14C may protrude through panel 16A and exit front surface 16A1.

Figure 1:
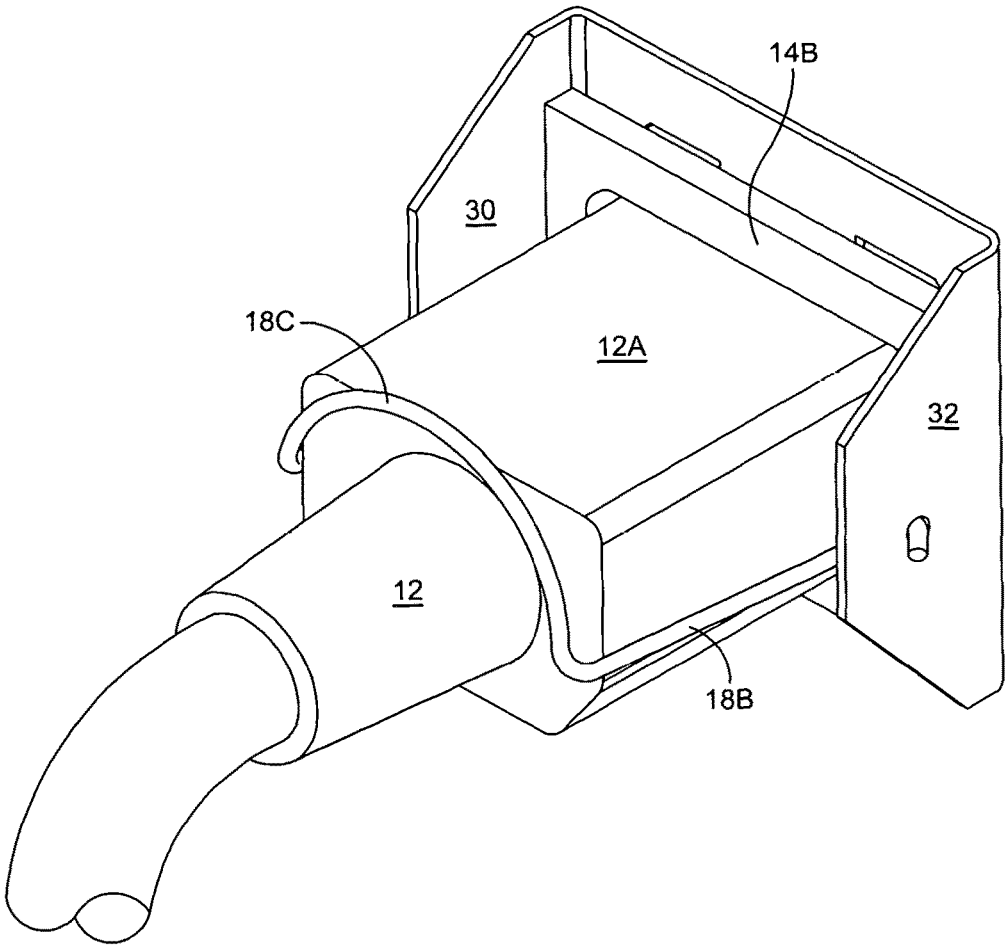
FIG. 1 is a perspective view of the power cord retainer of the present invention illustrated as securing a power cord in an outlet.
Figure 6:
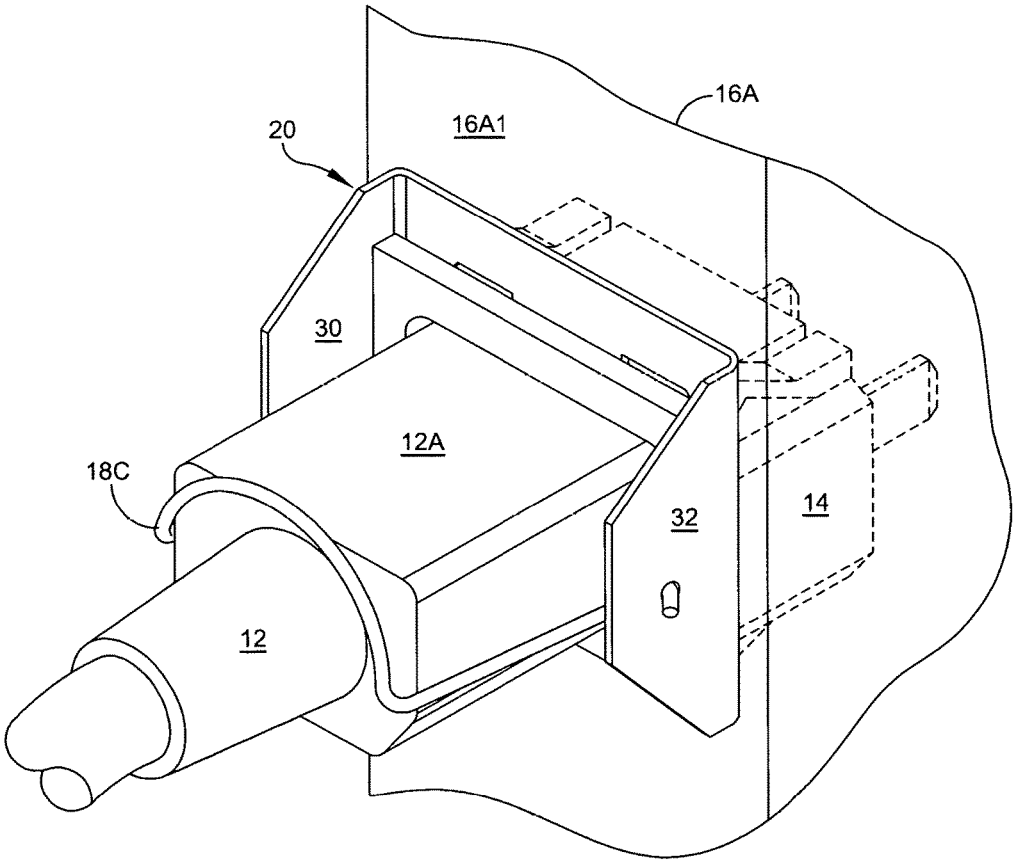
FIG. 6 illustrates the power cord retainer of the present invention installed on the face of an electrical enclosure and securing a power cord.

As illustrated in FIG. 4 and FIG. 5, Power Cord Retainer 10 is illustrated as inserted between front face lip extension 14B left 14B1, right 14B2 and top 14B3 rear surfaces and panel 16A. Since the resiliently flexible retention bars 14C flex, there is sufficient wiggle room to slideably engage Power Cord Retainer 10 between receptacle 14 lip extension 14B and enclosure 16 panel 16A front surface 16A1. Once installed, clip 18 is adaptable for clipping onto inserted power cord 12 end 12A. Clip 18 is shown in both a retracted (FIG. 5) and Engaged positions (FIGS. 1 and 6). The retainer 10 consists of a one-piece construction with a retention bar and is designed to hold a cord in place even when the cord is subjected to an extraction force.

Figure 3:
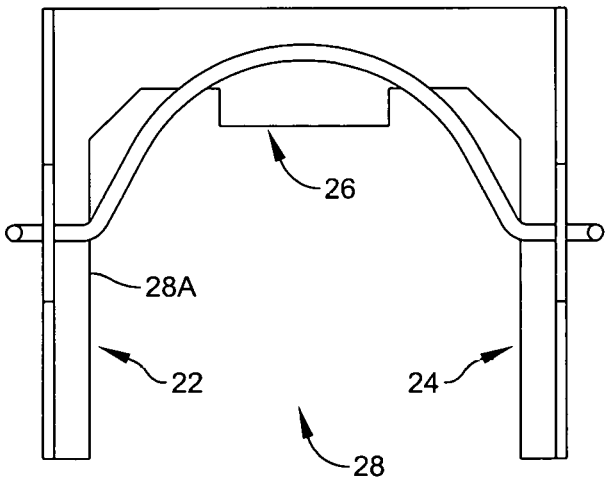
FIG. 3 is a front view the power cord retainer of FIG. 2.

Referring to FIGS. 2 and 3, power cord retainer 10 comprises a substantially flat rear panel 20 having a left side 22, right side 24 and top side 26 that define a u-shaped interior midsection 28 having a peripheral edge 28A. Opposing Left and right side sections 22 and 24 extend a distance from peripheral edge 28A up to opposing side panels 30 and 32, the opposing left and right side sections 22 and 24 including a front and rear surface. In the preferred embodiment, opposing side panels 30 and 32 are substantially orthogonal to left and right side sections 22 and 24 and extend forward of rear panel 20. Clip 18 includes a pair of arms 18A, 18B extending out from opposing side panels 30 and 32 to a hooked end 18C adaptable for engagement and securement of plug 12A of power cord 12 when plug 12A is inserted into receptacle 14. Clip 18 is adjustable from an engaged position (FIG. 6) to a disengaged position (FIG. 5).

In an alternative embodiment, side panels 30 and 32 could be removed or minimally extend outward from left and right side sections 22 and 24. In this case clip 18 arms 18A and 18B would need an alternative connection to power cord retainer 10, which could include direct connection of arms 18A and 18B to any portions of side panels 22 and 24 that are exposed after retainer 10 is installed. Rear panel 20 top side 26 includes a center engagement tab 26A, and recesses 34A and 34B located adjacent tab 26A. In the preferred embodiment, Retainer 10 rear panel 20 thickness is between 0.032 and 0.080 inches.

As illustrated in FIGS. 2-4 and 5, power cord retainer 10 is utilized to secure power cord 12 end 12A securely into receptacle 14. Retainer 10 opposing left and right side sections 22 and 24, and top section 26 slideably engage between front face lip extension 14B, left and right rear surfaces 14B1 and 14B2, and panel 16A front surface 16A1 up to a point where top section 26 tab 26A contacts receptacle 14 body portion 14A. Recesses 34A and 34B located adjacent tab 26A will accept any retention bars 14C that may protrude through panel 16A and exit front surface 16A1.

It should also be noted that the system described herein may be constructed of any suitable combination of rubber, plastic, metal, or any other viable composition that could withstand and readily accommodate the forces explained herein.

The embodiments shown of the present invention are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. An apparatus for retaining a plug in an outlet, the outlet including a body portion and a lip portion, the body portion secured within an electronic device enclosure panel opening by retention tabs positioned on the outlet body portion, the retention tabs in engagement with the interior of the enclosure panel to force the lip portion against the exterior of the enclosure panel, the apparatus comprising:

a substantially flat rear panel having a left, right and top side defining a u-shaped interior midsection, said left, right and top sides adaptable for engagement between said outlet lip portion and said enclosure panel exterior;

a securing portion extending outward from said rear panel to secure the plug in the outlet, wherein said securing portion includes a pair of arms extending outward from said left and said right sides of said rear panel to a hooked end, said hooked end adaptable for engagement with said plug for securing said plug in said outlet.

2. An apparatus for retaining a plug in an outlet as in claim 1, further including opposing side panels that are substantially orthogonal to said left and right side sections of said rear panel.

3. An apparatus for retaining a plug in an outlet as in claim 2, wherein said securing portion for securing said plug in said outlet extends outward from said opposing side panels.

4. An apparatus for retaining a plug in an outlet as in claim 1, wherein said top side of said rear panel further includes:

a center engagement tab; and at least one recess adaptable to accept a portion of said retention tab that exits the exterior of said enclosure panel.

5. An apparatus for retaining a plug in an outlet as in claim 4, wherein said at least one recess are positioned adjacent to said center engagement tab.

6. An apparatus for retaining a plug in an outlet as in claim 1, wherein said securing portion is adjustable from an open position to a closed position for securing said plug in said outlet.

7. An apparatus for retaining a plug in an outlet as in claim 2, wherein said securing portion includes a pair of arms extending outward from said left and said right side panels to a hooked end, said hooked end adaptable for engagement with said plug for securing said plug in said outlet.

8. A retainer clip in combination with a power receptacle for securing a plug within the receptacle, comprising:

a retainer clip comprising a substantially flat rear panel having a left, right and top side defining a u-shaped interior midsection, and opposing side panels that are substantially orthogonal to said left and right side sections of said rear panel said top side including opposing recesses positioned adjacent to a center engagement tab, an outlet having a front face and a body portion, the front face including an extended lip portion having a top, bottom, left and right interior surface, the body portion including retention tabs thereon;

said retainer left, right and top side adaptable for engagement with said extended lip portion left, right and top interior surface, said top side opposing recesses adaptable to accept a portion of said retention tabs therein;

a securing portion extending outward from said opposing side panels to secure the plug in the receptacle.

9. A retainer clip in combination with a power receptacle for securing a plug within the receptacle as in claim 8, wherein said securing portion includes a pair of arms extending outward from said left and said right sides of said rear panel to a hooked end, said hooked end adaptable for engagement with said plug for securing said plug in said outlet.

* * * * *